US008099881B2

(12) United States Patent
Yamamoto

(10) Patent No.: US 8,099,881 B2
(45) Date of Patent: Jan. 24, 2012

(54) BOOTS

(76) Inventor: Keika Yamamoto, Hyogo (JP)

( * ) Notice: Subject to any disclaimer, the term of this patent is extended or adjusted under 35 U.S.C. 154(b) by 668 days.

(21) Appl. No.: 12/084,365

(22) PCT Filed: Oct. 19, 2006

(86) PCT No.: PCT/JP2006/320880

§ 371 (c)(1),
(2), (4) Date: Jan. 27, 2009

(87) PCT Pub. No.: WO2007/052480

PCT Pub. Date: May 10, 2007

(65) Prior Publication Data

US 2009/0158621 A1 Jun. 25, 2009

(30) Foreign Application Priority Data

Oct. 31, 2005 (JP) ..... 2005-009075

(51) Int. Cl.
*A43B 23/00* (2006.01)

(52) U.S. Cl. ..... 36/45; 36/9 R; 12/142 R

(58) Field of Classification Search ..... 36/9 R, 36/45; 12/142 R, 146 C, 142 G
See application file for complete search history.

(56) References Cited

U.S. PATENT DOCUMENTS

| | | | | | |
|---|---|---|---|---|---|
| 1,750,397 | A | * | 3/1930 | Faulstich | 36/51 |
| 1,751,962 | A | * | 3/1930 | Walsh | 428/136 |
| 2,074,697 | A | * | 3/1937 | Kimpton | 36/1 |
| 2,121,604 | A | * | 6/1938 | Semke et al. | 36/44 |
| 2,341,675 | A | * | 2/1944 | Walsh | 36/19.5 |
| D144,199 | S | * | 3/1946 | Katz | D2/920 |
| 3,570,150 | A | * | 3/1971 | Field | 36/45 |
| 4,155,123 | A | * | 5/1979 | Popper | 2/239 |
| 4,654,982 | A | * | 4/1987 | Lee | 36/3 R |
| 4,809,447 | A | * | 3/1989 | Pacanowsky et al. | 36/9 R |
| 5,499,459 | A | * | 3/1996 | Tomaro | 36/10 |
| 5,542,191 | A | * | 8/1996 | Shouse et al. | 34/104 |

(Continued)

FOREIGN PATENT DOCUMENTS

JP 5944201 A 3/1984

(Continued)

OTHER PUBLICATIONS

Translation of JP-3641634-B1, Keika Yamamoto, Stretch Boot without Seam, and Production Method thereof, Apr. 25, 2005.*

*Primary Examiner* — Darnell Jayne
*Assistant Examiner* — Hiwot Tefera
(74) *Attorney, Agent, or Firm* — Lucas & Mercanti, LLP; Klaus P. Stoffel

(57) ABSTRACT

To provide boots which have hygienic and health advantages such as the ability to effectively deodorize the inside of the boots. The entire outer surface excluding the sole of the boot is made of a material which is formed into an integrated body by continuously knitting a yarn and, in the material, at least the instep-covering part to cover the toe or the instep of the foot is knitted out of a yarn including a fiber into which minute particles having one or more functions selected from among deodorizing function, antibacterial function or blood circulation promoting function. The boot can also be formed by knitting a twine which is made by twisting a fiber into which minute particles having deodorizing function, antibacterial function or blood circulation promoting function around a fiber which has high elasticity.

8 Claims, 6 Drawing Sheets

U.S. PATENT DOCUMENTS

| | | | | |
|---|---|---|---|---|
| 6,308,438 | B1 * | 10/2001 | Throneburg et al. | 36/9 R |
| 6,991,691 | B2 * | 1/2006 | Yoon | 156/92 |
| D630,832 | S * | 1/2011 | Ng | D2/970 |
| 2004/0134098 | A1 * | 7/2004 | Beck | 36/44 |
| 2004/0200094 | A1 * | 10/2004 | Baychar | 36/55 |
| 2004/0205982 | A1 * | 10/2004 | Challe | 36/55 |
| 2004/0261294 | A1 * | 12/2004 | Kawata | 36/44 |
| 2005/0102862 | A1 * | 5/2005 | Baychar | 36/55 |
| 2005/0138844 | A1 * | 6/2005 | Johnson | 36/44 |

FOREIGN PATENT DOCUMENTS

| | | | |
|---|---|---|---|
| JP | 3063508 | U | 8/1999 |
| JP | 2004052208 | A | 2/2004 |
| JP | 3641634 | B1 * | 4/2005 |

* cited by examiner

BOOTS

TECHNICAL FIELD

The present invention relates to boots that have hygienic and health merits such as a deodorization effect.

BACKGROUND OF THE INVENTION

A boot, covering the part from the toe to the ankle or further to the calf, is generally low in breathability. Therefore a bad smell caused by sweating for example tends to be shut therein. The taller the boot is or the more tightly it fits on the calf and other parts, the more the tendency will increase.

Lately what we call stretch boots are attracting attention, which are made of a stretch material and can nicely fit any legs and effectively show them shapely. FIG. 6 shows one of the examples. When wearing such a stretch boot which nicely fits the leg, the air can hardly go in and out through the space between the calf and the boot. That requires special consideration regarding means for deodorization. Each stretch boot 41, 42 and 43 shown in FIG. 6 is formed by cutting flat materials with punching dies or the like first, and then sewing them up at each seam or joint 41*a*, 42*a* and 43*a* to form the part covering the instep and a cylindrical part covering the leg above the instep.

Regarding means for deodorization, the stretch boot described in the patent document 1 below for example has a breathable sheet forming the part near the arch of a foot, through which the bad smell or foul odor can exhale from the boot.

Patent Document 1: JP-U 3063508

However, the use of the breathable sheet in part of the boot (near the arch of a foot), according to the description of the patent document 1, often does not provide sufficient effect of deodorization. That is because some ingredients of the sweat sticking widely in the boot may smell bad. While, excessive breathability of the boot for releasing the bad smell may unfavorably make the foot cold in winter.

The boot has also a demerit in the appearance such that seams are created by sewing the breathable sheet thereon. Since a boot is required to have a function to cover the leg warm and also to be fashionable, it is not favorable that a seam appears outside. On that point, each stretch boot 41, 42 and 43 shown in FIG. 6 also leaves room for improvement because it is formed by sewing up cut materials and has each seam 41*a*, 42*a* and 43*a* on both the back and front center lines and on the part covering the instep.

DISCLOSURE OF THE INVENTION

Problems to be Solved

To solve the above problems, the present invention provides novel boots which have hygienic and health advantages such as the ability to effectively deodorize the inside thereof and a thermal effect, and are favorably fashionable.

Means to Solve the Problems

A boot according to the present invention is characterized in that at least the part to cover from the toe to the instep of the foot is formed by knitting a yarn (or knitted out of a yarn) including a fiber into which minute particles (for example, fine grains of about 1 μm in particle diameter) having (one or more functions selected from among) deodorizing (or odor eliminating) function, antibacterial function and blood circulation promoting function have been interwoven, or formed by cutting and sewing up materials made of the fiber (into which the minute particles have been interwoven).

In this boot the minute particles interwoven into the fibers function to provide for example deodorization effect; that is advantageous in hygiene and health. In other words, as the fiber, into which such minute particles have been interwoven, is distributed at least in the part covering from the toe to the instep, (one or more actions among) deodorizing action, antibacterial action and blood circulation promoting action are effectively provided in the part which is most sweaty, easy to smell bad, easy to generate bacteria, and easy to get cold especially in winter by poor blood circulation.

As to the boot of the present invention, it is particularly preferable that:

- the entire outer surface (excluding a boot sole) is made of a material which is formed into an integrated body by continuously knitted out of a yarn; and
- at least the part to cover from the toe to the instep of the foot (the part can be included in either the integrated material or other material placed the inner position) is formed by knitting the yarn including the fiber into which the minute particles have been interwoven.

Thus made, the boot has hygienic and health effects that are caused by the action of the fiber into which the minute particles have been interwoven, and is excellent from the viewpoint of fashion at the same time. This is because the outer surface of the boot is formed of the integrated material, which is made by continuously knitting a yarn, without any other cut material sewed thereon; and that provides the boot a smooth silhouette and nice exterior.

In the case of forming out of a yarn like that, the boot can be a knitted stretch boot. As the outer surface is formed by knitting a yarn, it is not necessary to prepare various punching dies for different designs and seizes, further no waste material is generated, and furthermore any knitting pattern can be included. Generating no waste material is advantageous also in relation to the resources and environment. Making the cylindrical material, which forms the outer surface of the boot, by continuously knitting a yarn is executed by, for example, a) hand-knitting, b) using a weft knitting machine like WHOLEGARMENT (a registered trademark) which is capable of three-dimensional seamless knitting or c) using a V-bed weft knitting machine having a needle bed in front and in the rear respectively, where a carriage is reciprocating while taking a knitting yarn around the knitting needles on the front bed and the rear bed to feed them the yarn alternately. In the case of c), in order to provide a desired form to the cylindrical material, it is preferable to increase or decrease the knitting width in the middle of knitting by altering the numbers of needles held in the working position (see the published official gazette JP A S60-194154). In all cases from a) to c), a yarn connection in the middle of knitting enables to form a part of the material out of a different yarn while continuously knitting an integrated material.

As to the boot, it is further preferable that:

- the boot is formed to cover the leg and foot (excluding the sole of the foot: the part covered by a boot excluding the sole) with a single material having a part made by knitting the yarn including the fiber into which the minute particles have been interwoven; and
- an inextensible piece, which fixes the shape of the part covering from the instep to the back of the heel, is covered with and stuck to (the inside of) the material, and the material, only at the back of the heel, has a seam created by sewing up with the inextensible piece. The boot 1 shown in FIG. 1 and FIG. 2 is one of the examples.

The boot like this has the following advantages:

i) As the material to cover the leg is an integrated and single body made up by continuously knitting a yarn, the boot is simple in structure and relatively easily made up by composing a small number of parts. Without being sewed together with other cut materials, the boot has a smooth silhouette and nice exterior; that makes the boot fashionable, and further has hygienic and health effects exerted by the action of the minute particles. Since the single material is simple in structure and made up by knitting, it is easy to arrange lace-like meshes at any parts so as to make the boot look like refreshing, thereby raising the ability to follow or lead fashion and improving breathability.

ii) The material has one seam at the back of the heel though, the boot yet has a simple and nice silhouette because the seam at the position is unobtrusive and there are no seams at any other positions such as the instep and either side of the instep. Moreover, as the seam is positioned at the back of the heel, it is possible to stick the inextensible piece on the part of the material below the ankle in almost a plane state until sewing up the seam. Therefore sticking of the inextensible piece is smoothly carried out (a boot that does not have any seams at every position including the back of the heel is cylindrical from the beginning in the part from the instep to the back of the heel, therefore the work to stick the inextensible piece on the part needs a skilled person).

As to the boot, it is also preferable that:

a cylindrical material which is provided with an instep-covering part at each end thereof and formed into an integrated body by continuous knitting is folded back in half so as to make up a folded cylindrical body;

an inextensible piece for fixing the form of the part covering from the instep to the back of the heel is sewed on the inner material of the ends which are overlaid with each other after being folded back; and in the cylindrical material, only the part (at least the part covering from the toe to the instep) which goes to the inner position after folding back is formed by knitting the yarn including the fiber into which the minute particles have been interwoven. The boot shown in FIG. 3 and FIG. 4 is one of the examples.

Thus made, the boot has the following advantages:

i) The boot is simple in structure and can be relatively easily manufactured by composing a small number of parts because the part for covering the leg and foot is made of only the cylindrical material which is continuously knitted into an integrated body without other cut materials sewed thereon. Moreover, it is possible to leave no seams or joints in the outer material therefore the boot can be smooth in silhouette and fashionable and further has the hygienic and health effects caused by the action of the minute particles.

ii) Since the cylindrical material is folded back in half, the boot has a high thermal effect and is strong enough to keep its shape better. Further the boot has a nice exterior because the end of the material is not seen in the circular upper edge, where the material is folded back. Furthermore although the inextensible piece is sewed on the part covering the instep, etc., the boot still has an excellent exterior because the outer seamless material covers the material on which the piece is sewed to keep any seam out of sight.

iii) The boot is economical and advantageous to be more fashionable because the only inner part of the double cylindrical material is formed by knitting the yarn including the fiber into which the minute particles have been interwoven. Actually it is possible to decrease the amount of the special yarn including the minute particles and form the outer part by knitting other attractive yarn (including lame for example).

Particularly it is preferable to attach a circular rubber member to the part in the folded material near the middle of the cylindrical material.

Thus made, the boot is prevented from slipping down the calf by the elastic force of the rubber element. Generally a fiber which has deodorization function, antibacterial function or blood circulation promoting function is poor in elasticity. Accordingly there is unfavorable possibility that a boot composed of the fiber slips down the calf to some degree while wearing and looses the original shape. The rubber element fixed in that way can prevent the inconvenience. The rubber element can be attached by sewing or gluing to the part in the folded material near the middle of the cylindrical material (that is, near the upper end of the boot). As the rubber element is out of sight, hiding in the folded material, the external appearance will be never damaged.

The fiber into which the minute particles have been interwoven can be a fiber into which one or more among bincho charcoal, a photocatalyst (a titanium oxide for example), sulfur, germanium ore, and zirconium ore have been interwoven.

The particle of bincho charcoal, a photocatalyst (a titanium oxide for example), sulfur, germanium ore, or zirconium ore has one or more functions among the deodorizing or odor eliminating action caused by adsorption of ammonia or the like, the antibacterial action of controlling the increase of bacteria such as ringworm, the blood circulation promoting action caused by, for example, the far-infrared radiation, the cleaning action caused by dissolving dirt and the comforting action caused by generating negative ions. Therefore the boot made up by using this fiber can provide the hygienic and health merits to the user of the boot.

To be concrete, the fiber can be for example: KISHU BINCHOZUMI SEN-I (a trademark) of Omikenshi Co., Ltd., which is made by interweaving bincho charcoal into rayon fiber; ONSEN SEN-I CELUUNA (a trademark) of the same corporation, which is made by interweaving sulfur into rayon fiber; SUNDIA (a trademark) of the same corporation, which is made by interweaving photocatalyst (titanium oxide) into rayon fiber; and CHIOCLEAN (a trademark) of Kiyokawa Co., Ltd., which is made by interweaving germanium ore and zirconium ore into rayon fibers. The minute particles can be interwoven into also other chemical fibers and natural fibers instead of rayon fiber.

It is also preferable that the boot of the invention is formed, at least in the part to fully or partially cover from the calf to the ankle, by knitting a multi-function yarn which has the high elasticity together with the deodorizing function, antibacterial function or blood circulation promoting function.

The boot made of the multi-function yarn like this has the hygienic and health effects as mentioned above and additionally has the following effects:

a) It is possible to compose the boot to look nice and highly fashionable showing a smooth silhouette to fit along the calf, etc., when wearing, because the high elasticity of the multi-function yarn enables the boot to nicely fit the leg.

b) It is possible to keep the boot in a fine silhouette preventing it from slipping down while wearing also because the high elasticity enables the boot to nicely fit the leg.

Generally a fiber which has the deodorization function, antibacterial function or blood circulation promoting function is poor in elasticity. Accordingly it is difficult to give a good exterior brought by fitting nicely the calf to a boot composed of the general fiber. The boot made of the multi-function yarn as mentioned above, however, has not only the hygienic and health effects but also the effect in relation to fashion.

The boot tightly contacts with the calf, etc. though, it is soft enough because of the elasticity of the multi-function yarn. Therefore the boot can be composed wearable for long time without causing fatigue. The proper setting of the elastic force of the multi-function yarn enables to provide the boot with supporting effect and massaging effect for the calf, etc. As knitting a yarn generates no waste material, the boot of this invention has also advantages in relation to the resources and environment.

The multi-function yarn can be a twine made by twisting a fiber into which minute particles with the deodorizing function, antibacterial function or blood circulation promoting function have been interwoven (like the fiber into which bincho charcoal, germanium ore, etc. have been interwoven), and a fiber with high elasticity (like a polyurethane elastic fiber).

The twine like this has the high elasticity together with the deodorizing function, antibacterial function or blood circulation promoting function. Therefore the boot formed by knitting as mentioned above can have the hygienic and health effects and also the effect in relation to fashion.

In particular it is preferable that the entire outer surface (excluding the sole) is made of an integrated material which is formed by continuously knitting a yarn.

Thus made, the boot has a smooth silhouette and shapely exterior because any other cut material is not sewed on the outer surface thereof. Making the outer surface by continuously knitting a yarn is executed by the same way as mentioned above: for example, a) hand-knitting, b) using a weft knitting machine like WHOLEGARMENT (a registered trademark) which is capable of three-dimensional seamless knitting or c) using a V-bed weft knitting machine having a needle bed in front and in the rear respectively, where a carriage is reciprocating while taking a knitting yarn around the knitting needles on the front bed and the rear bed to feed them the yarn alternately.

It is preferable that the boot further has the features such as:

- the boot is formed to cover the leg and foot (excluding the sole of the foot: the part covered by a boot excluding the sole) with a single material including the part knitted out of the multi-function yarn; and
- an inextensible piece which fixes the shape of the part covering from the instep to the back of the heel is covered with and stuck to (the inside of) the material, and the material, only at the back of the heel, has one seam created by sewing up with the inextensible piece (there is no seam except the back of the heel).

This boot has almost the same appearance as the boot 1 shown in FIG. 1 and FIG. 2 and has the following effects:

i) As the material to cover the leg is knitted into an integrated and single body, the boot is simple in structure and relatively easily made by composing a small number of parts. Without being sewed together with other cut materials, the boot has a good exterior and further has the hygienic and health effects caused by the action of the multi-function yarn. Composed of the knitted single material, the boot is easily provided with lace-like meshes at any part desired to show itself refreshing therefore being advantageous from the viewpoint of fashion and breathability.

ii) This material has one seam at the back of the heel, however, the seam at the position is unobtrusive and there is no seam at any other position: therefore the boot has an outstanding exterior. Moreover, as the seam is positioned at the back of the heel, it is possible to stick the inextensible piece on the material below the ankle in almost a plane state until sewing up the seam. Therefore the sticking of the inextensible piece is smoothly carried out.

iii) Compared with the case of knitting a yarn which lacks high elasticity, the boot has the advantage in exterior such that the boot can tightly contacts to the calf and prevents from slipping down. It is important that the boot has no seam except the back of the heel. On that ground, contacting the boot to the calf more tightly by a multi-function yarn with stronger elasticity for preventing slip down will not cause the localized pain or itch at the skin.

As to the boot, it is also preferable that:

- a cylindrical material which is knitted into a continuous and integrated body being provided with an instep-covering part at each end thereof is folded back in the middle of the length so as to make a folded cylindrical body;
- an inextensible piece for fixing the form of the part covering from the instep to the back of the heel is sewed on the inner material of the ends which are overlaid with each other after folding back; and
- in the cylindrical material, only the part (at least in the part to cover from the toe to the instep) which goes to the inner position after folding back has a part formed by knitting the multi-function yarn.

This boot is almost the same as the boot 21 shown in FIG. 3 and FIG. 4 and has the following advantages:

i) The boot is simple in structure and can be relatively easily made by composing a small number of parts, since the cylindrical material made by knitting into a continuous and integrated body alone is used to cover the leg and foot. Moreover, it is possible to leave no seams (or joints) in the outer material. As a result the boot has an excellent exterior and further has the hygienic and health effects by the action of the multi-function yarn.

ii) Since the cylindrical material is folded back to be a double body, the boot has the high thermal effect and sufficient strength to keep its shape better. Further the boot has a nice exterior because the inner material with inextensible piece to cover the instep, etc. sewed thereon is covered by the other seamless material; that prevents any seam from appearing outside.

iii) Compared with the case of knitting a yarn which lacks high elasticity, the boot has the exterior advantage that it can tightly contact to the calf and prevent from slipping down. It is important that the boot is also economical and advantageous in fashion, since the part formed by knitting the multi-function yarn is limited to the part in the inner material of the folded cylindrical material. Actually it is possible to decrease the amount of the multi-function yarns and make the outer part by knitting other attractive yarns (including lamé for example). It is also possible to reduce the production cost by making up many types of boots which have the outer part provided with a variety of colors and designs while using the common material including the multi-function yarn for the inner part of every boot.

In this case, it is also preferable to attach a circular rubber member to the part in the folded material near the middle of the cylindrical material.

Thus made, the boot is prevented from slipping down the calf more steadily by the elastic force of the rubber member and can particularly keep a nice silhouette while wearing. There is another advantage that the multi-function yarn becomes to have a greater choice, since the use of a lower elastic multi-function yarn will be enough to prevent the boot from slipping down. The rubber member can be attached by sewing or gluing to the part in the folded material near the middle of the cylindrical material (that is, near the upper end of the boot). As the rubber member can hide in the folded material, the external appearance is never damaged.

EXPLANATIONS OF LETTERS OR NUMERALS

1 Boot
2 Material
3 Cylindrical Part
4 Instep-Covering Part
5 Joint
10 Inextensible Piece
21 Boot
22 Instep-Covering Part
23 Cylindrical Part
25 Inextensible Piece
31 Material (Cylindrical Material)
31*a* Outer Material
31*b* Inner Material
53 Twine

DESCRIPTION OF PREFERRED EMBODIMENT

Figure 1:
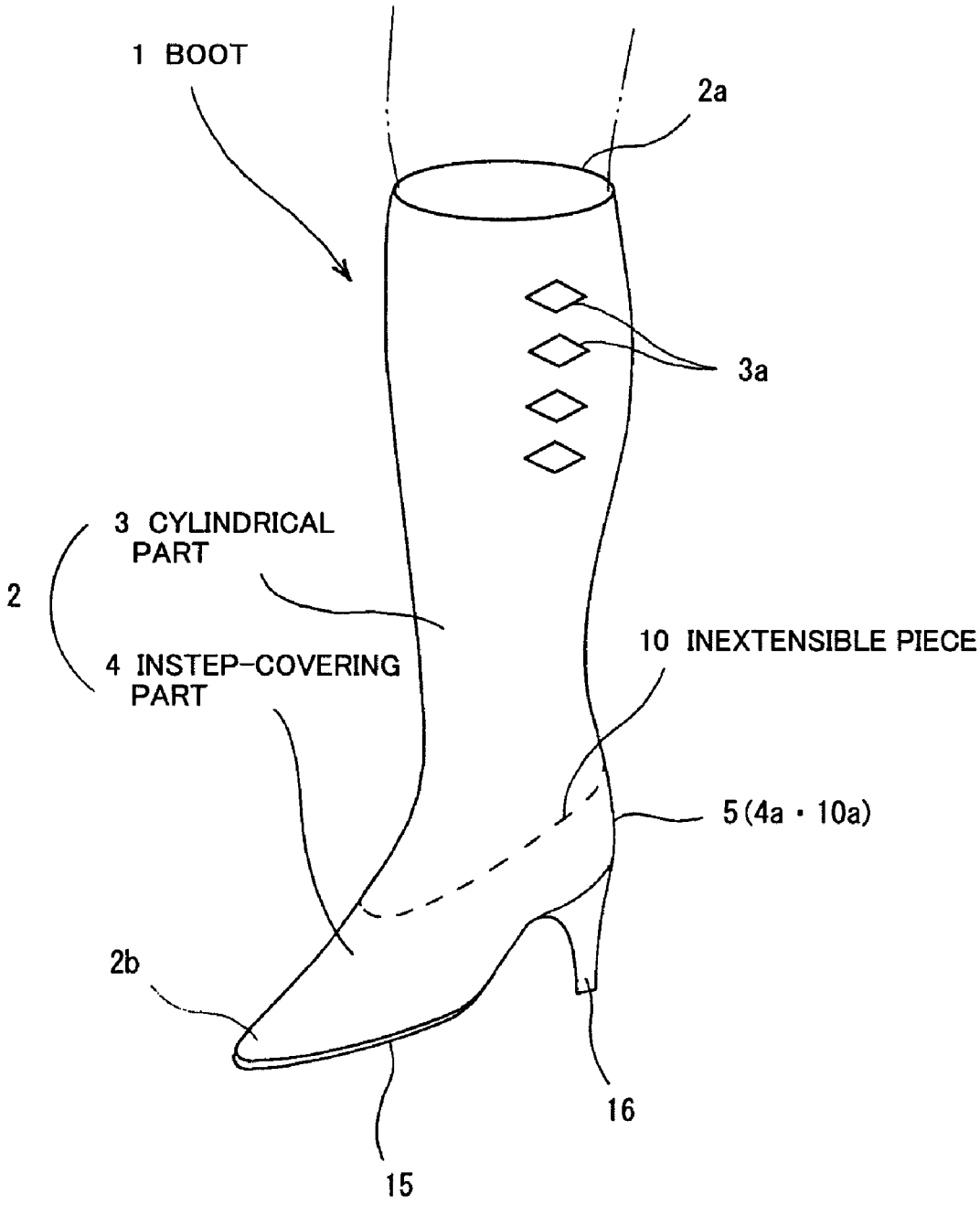
FIG. 1 is a perspective view of the boot 1 of one embodiment according to the present invention.
Figure 2:
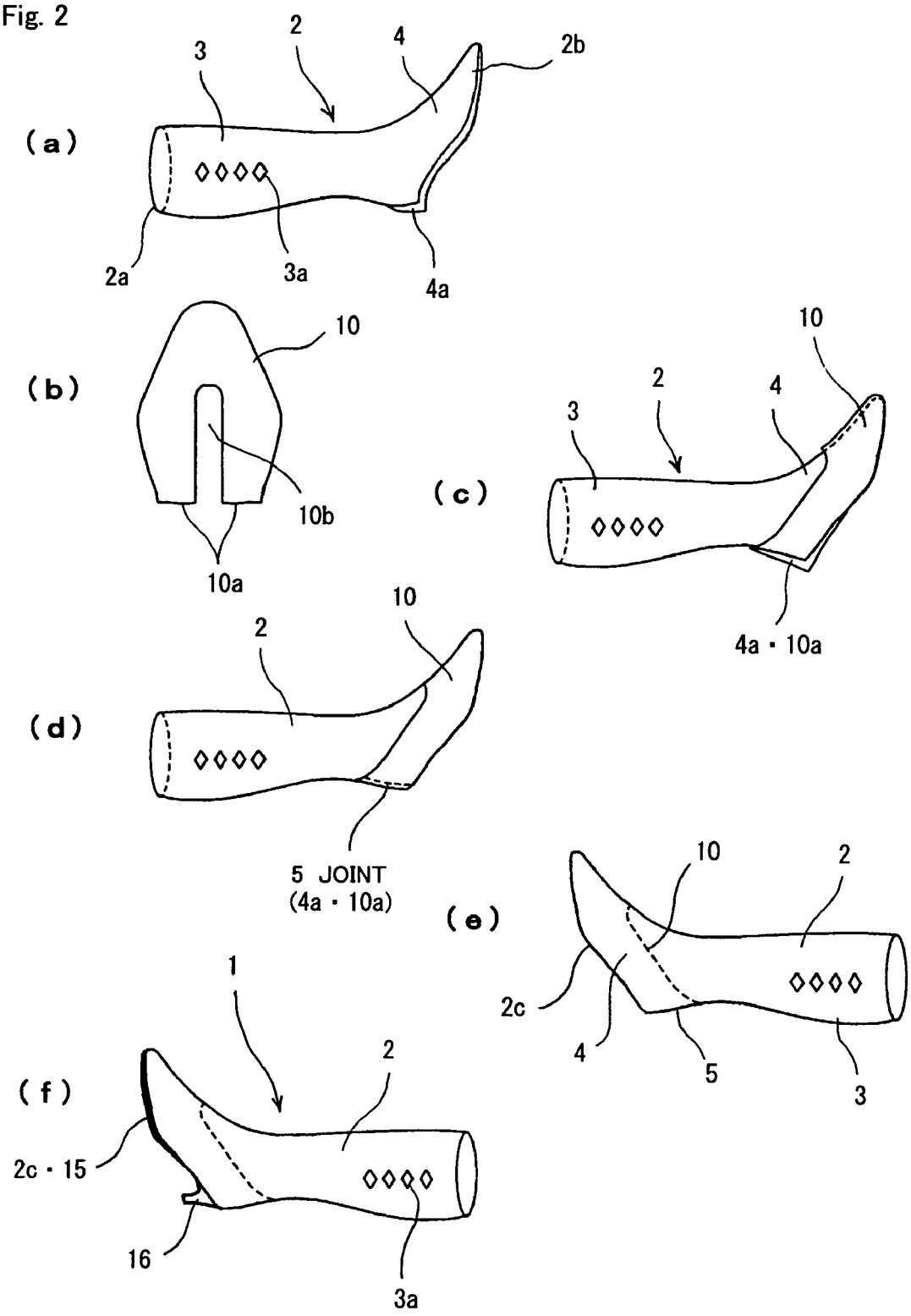
FIG. 2(*a*)-2(*f*) are illustrations for explanation of the production method of the boot 1 of one embodiment according to the present invention.

Referring to FIG. 1 and FIG. 2, one embodiment of the invention is described as follows.

FIG. 1 shows a perspective view of the boot 1 (stretch boot) and FIG. 2(*a*)-2(*f*) is illustrations for explanation regarding the production method of the boot 1.

As shown in FIG. 1, the boot 1 is made up by forming the cylindrical part 3 above the ankle and the instep-covering part 4 to cover from the instep to the back of the heel out of an elastic material 2 of a continuous and integrated body and then attaching a sole 15 and a heel 16 under the instep-covering part 4. The material 2 alone covers the entire outer surface (excluding the sole 15) of the boot 1. The material 2 is entirely formed into a continuous and integrated body by knitting a yarn including a fiber into which minute particles of titanium oxide as a photocatalyst (for example, the SUNDIA (a trademark) produced by Omikenshi Co., Ltd.) have been interwoven. The titanium oxide is widely distributed in the material 2 and reduces ammonia, sterilizes a colon bacillus or the like and dissolves the dirt caused by dust or sebum; therefore the boot 1 has favorable actions such as deodorizing action, antibacterial action and cleaning action at any part thereof.

The cylindrical part 3 of the material 2 is provided with lace-like meshes 3*a* and formed to be a single body without any other material put thereon so that the color of the skin may be seen through the meshes 3*a*. The instep-covering part 4 of the material 2 is, at the inside thereof, provided with an inextensible piece for fixing the shape of a shoe. The material 2 has a joint 5 (a seam: the part sewed up) at the back of the heel of the instep-covering part 4, however, has no seam in the other part. Therefore advantageously the boot 1 has a simple and nice exterior, and further has the breathability brought by the lace-like meshes 3 arranged in the upper part, which can prevent the internal part of the boot from getting stuffy and show the boot refreshing. It is a matter of course that the shape and size of the boot 1, the quality and thickness of the material 2 (including a panty hose-like material), and the mode (including a pattern and roughness of a stitch) of the meshes 3 are not limited to the embodiment shown in FIGS. 1 and 2. For the fiber which has the effects such as deodorization, a fiber into which bincho charcoal, sulfur or germanium is interwoven instead of photocatalyst can be used. It is also preferable to use the yarn including such a fiber in local part (for example, only the part to cover from the toe to the instep) not in entire material 2.

A manufacturing process of the boot 1 shown in FIG. 1 is described in the following steps 1)-6):

STEP 1): The first process is to knit the material 2 which is seamless and has the cylindrical part 3 at its upper end 2*a* and the instep-covering part 4 at its lower end 2*b* (FIG. 2(*a*)), by a V-bed weft knitting machine or the like (not illustrated). The yarn including titanium oxide as described above is used. The lace-like meshes 3*a* are formed in the cylindrical part 3. The instep-covering part 4, which is the part below the ankle, is knitted to form a plane (a sheet of material folded back at the toe part) not a cylinder by making a break 4*a* to divide the back part of the heel into the left and right sections.

A V-bed weft knitting machine has the front and the back needle beds and reciprocates a carriage while turning a knitting yarn around the knitting needles on the front needle bed and those on the back needle bed thereby feeding them the yarn alternately to form a cylindrical knit. The width of knitting can be changed, while knitting, by a program which varies the number of the needles held on the working position so that the instep-covering part 4 and the cylindrical part 3 can fit the leg and foot. It is also possible to provide the meshes 3*a*. Preferably the weft knitting machine can be WHOLEGARMENT (a registered trademark) or the like which is capable of three-dimensional seamless knitting. Naturally the cylindrical material can be formed by hand-knitting.

In this way of production, the material 2 is formed to be seamless and three-dimensional, and further no waste material is generated because it is unnecessary to cut a material.

STEP 2): To prepare the inextensible piece 10 as a member which covers the part from the instep to the back of the heel and fixes the shape of the part (FIG. 2(*b*)). The inextensible piece 10 is shaped by cutting a sheet of a slightly thick and hard synthetic fiber or the like, and has both an end part 10*a*, which is divided into two, at the part to form the back of the heel and a slit 10*b* at the part where the ankle enters.

STEP 3): To stick the inextensible piece 10 prepared in the STEP 2 on the instep-covering part 4 of the material 2 knitted in the STEP 1 (FIG. 2(*c*)). The preferable sticking method is the thermocompression bonding after SPS processing (sticking of a resin film for bonding) or the use of adhesive (SPS: Syndiotactic Polystyrene).

It is also possible to knit the instep-covering part 4 into a cylinder without the break 4*a*, form the inextensible piece 10 into a curved (cylindrical) sheet without dividing into the left and right parts and then stick them together by the thermocompression or the like. However, it is advantageous to use the instep-covering part 4 knitted into a plane by dividing into the left and right parts at the break 4*a*, and the inextensible piece 10 shaped in a plane; because that makes the work of thermocompression bonding easy and variety types of press benches for different design and size are unnecessary thereby lowering the manufacturing cost and saving time.

STEP 4): To sew up the divided end part 10*a* of the inextensible piece 10 together with the material near the break 4*a* of the instep-covering part 4 to leave a seam 5 (FIG. 2(*d*)). Thus, also the instep-covering part 4 is formed into a cylinder which continues from the upper part.

STEP 5): To turn inside out of the entire cylindrical material 2 including the sewed-up instep-covering part 4 (FIG. 2(*e*)). In the cylindrical part 3 as the upper part, the lace-like meshes 3*a* appears in the same mode because it is a single material, while in the instep-covering part 4 as the lower part, the inextensible piece 10 is hidden inside the material 2 and the seam 5 becomes unobtrusive. As there is no other seam except at the back of the heel, the outer surface of the material exhibits considerably smooth and nice silhouette after turning inside out. It is preferable to attach a reinforcing member called tip padding to the part inside the toe or another reinforcing member called counter (lunette or hot-melt) to the part inside the heel.

STEP 6): To fix a sole 15 and a heel 16 to the open edge 2*c* of the material 2 in the side of the instep-covering part 4 (FIG. 2(*f*)). As it is generally done, an insole (not illustrated) is fixed to inside of the opening edge 2*c* of the material 2 and then a main sole (not illustrated) and the heel 16 are fixed under the outside of these elements (i.e. under a boot).

Figure 3:
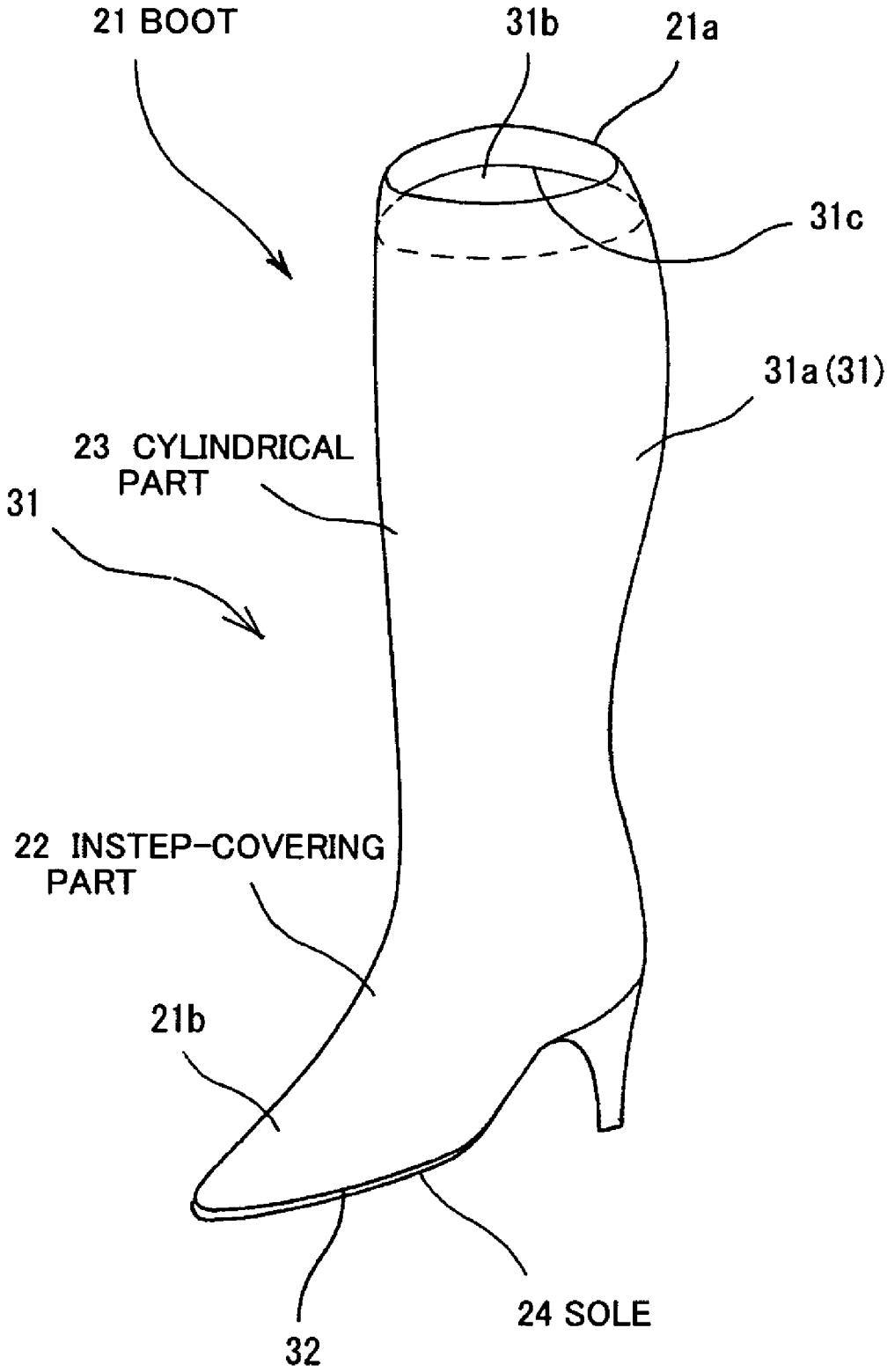
FIG. 3 is a perspective view of the boot 21 of another embodiment according to the present invention.
Figure 4:
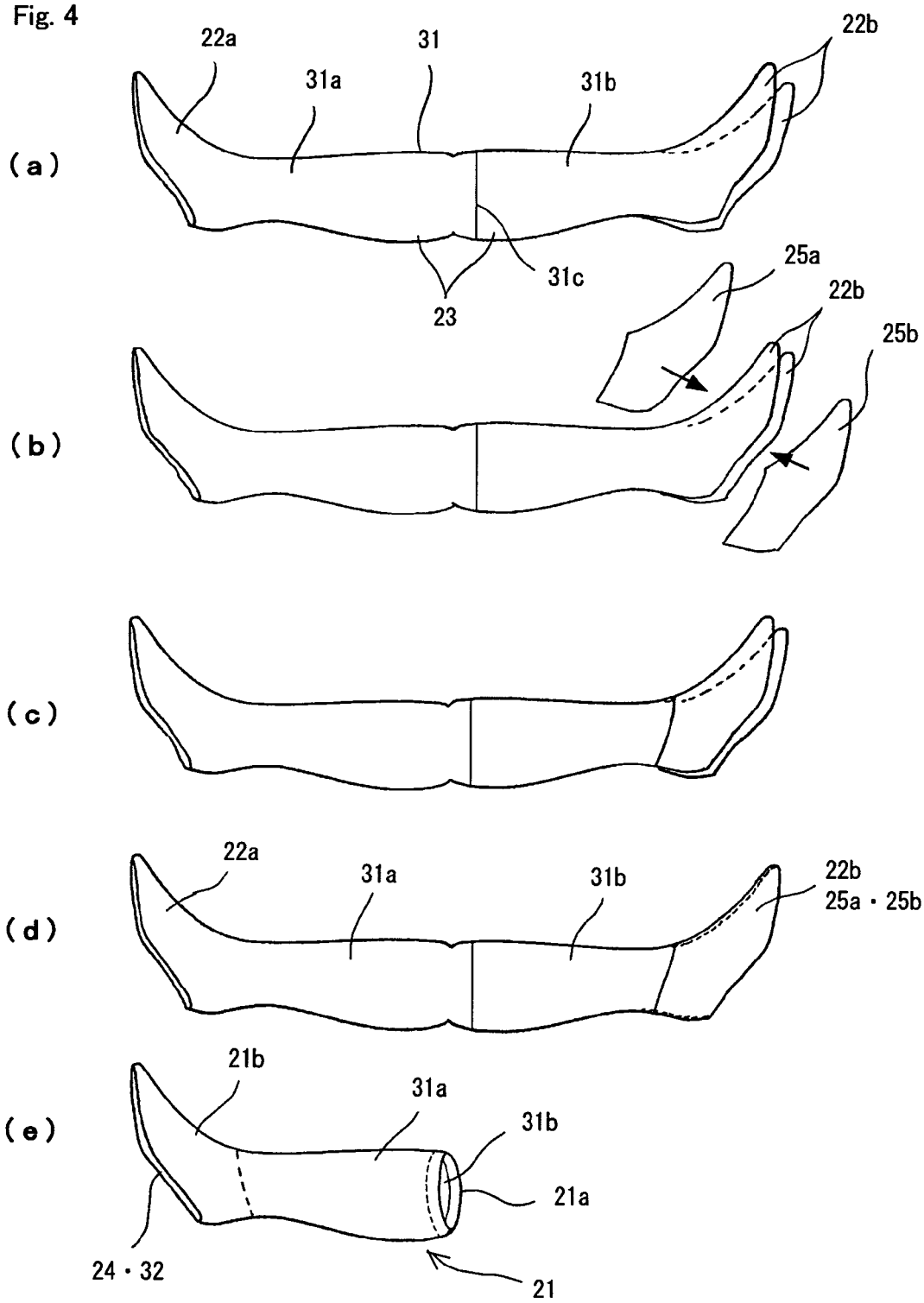
FIG. 4(*a*)-4(*e*) are illustrations for explanation of the production method of the boot 21 of one embodiment according to the present invention.

Another embodiment according to the invention is described as follows referring to FIG. 3 and FIG. 4. FIG. 3 is a perspective view of a boot 21 (stretch boot) and FIG. 4 is an illustration to explain a manufacturing method of the boot 21.

The boot 21 is made up by integrally forming an instep-covering part 22 to cover the instep of the foot and a cylindrical part 23 to cover the leg above the instep of a seamless cylindrical material 31, and then attaching a sole 24 to the opening edge 32 of the instep-covering part 22. The cylindrical part 31 is folded back in half so that a fold is created at the upper edge 21*a*. An inextensible piece 25 is attached to the toe part 21*b* of the inner material (reference letter: 31*b*) by thermocompression bonding and sewing. The outer material (reference letter: 31*a*) is seamless.

The outer material 31*a* of the folded cylindrical material 31 is knitted out of an attractive yarn including lame, while the inner material (reference letter: 31*b*) is knitted out of a yarn including a fiber into which the minute particles of bincho charcoal, such as the KISHU BINCHOZUMI SEN-I (a trademark) of Omikenshi Co., Ltd., are interwoven. The outer material 31*a* and the inner material 31*b* are classified with each other at a borderline 31*c* which is located in the part slightly (a few centimeters) inside the fold at the upper edge 21*a*, however, the both are continuously knitted to form an integrated body. In the inner material 31*b*, the minute particles of bincho charcoal are widely distributed to absorb ammonia, radiate far-infrared and generate anion thereby favorably exerting deodorization action, blood circulation promoting action and air-cleaning action in the entire inside of the boot 21.

It is a matter of course that the shape and size of the boot 21, the quality and thickness of the material 31*a* and 31*b* are not limited to the embodiment mentioned above. For the fiber which has the effects such as deodorization, a fiber into which photocatalyst, sulfur or germanium ore is interwoven instead of bincho charcoal can be used.

A manufacturing process of the boot 21 is described in the following steps 1)-5) as shown in FIG. 4:

STEP 1): The first process is to knit the cylindrical material 31 which has the cylindrical part 23 at its center and the instep-covering parts 22*a* and 22*b* at its both ends (FIG. 4(*a*)), by a V-bed weft knitting machine (not illustrated). The instep-covering part 22*a*, to be the outer part, is knitted into a cylinder, while the instep-covering part 22*b*, to be the inner part, is knitted into a plane so that the instep part and the heel part are divided into the left and right sections.

When knitting the cylindrical material 31, the outer material 31*a* and the inner material 31*b* are continuously knitted to form an integrated body as described above though, it is necessary to change yarns at the time when the knitted part reaches the borderline 31*c*. Changing yarns is executed by switching the two yarns and continuing to operate the V-bed weft knitting machine.

The outline of the V-bed weft knitting machine and the knitting method using the machine are the same as described above. Also the cylindrical material can be knitted by a weft knitting machine like WHOLEGARMENT (a registered trademark) or by hand-knitting.

As described above, the cylindrical material 31 is formed to be seamless and three-dimensional and it is not necessary to cut materials therefore no waste material is generated.

STEP 2): To stick each of a pair of inextensible pieces 25*a* and 25.*b* for determining the shape of the part covering the instep to the instep-covering part 22, which is knitted into the right and left parts separately, by thermocompression bonding after SPS processing (FIGS. 4(*b*) and 4(*c*)).

It is also possible to knit the instep-covering part 22*b* into a cylinder not into two parts, form the inextensible piece 25 into a curved shape without dividing into the right and left parts and then bond them together by thermocompression. However, forming the plane instep-covering part 22*b* by separately knitting the right and left parts makes it easy to carry out thermocompression of the inextensible piece 25 and further makes a variety of press benches for different design and size unnecessary, thereby enabling to lower the manufacturing cost and to save time.

STEP 3): To sew up the right and left inextensible piece 25*a* and 25*b* together with the instep-covering part 22*b* at the instep side and the heel side respectively (FIG. 4(*d*)).

Being sewed up with the material, the inextensible piece 25 is steadily integrated with the material.

STEP 4): To fold back the cylindrical material 31 so that the seamless instep-covering part 22*a* is turned inside out and laid on outside of the instep-covering part 22*b* (the material 31*b*).

The seam at the instep-covering part 22*b* which is created by sewing up the right and left inextensible piece 25 together with the material is hidden in the instep-covering part 22*a* of the seamless material 31*a* after folding back the cylindrical material 31 in this way. As a result, the external appearance is not damaged. Moreover, the boot 21 looks nice because the end of the material does not appear at the upper edge 21*a* thereof. Furthermore, as it is unnecessary to sew up the double materials at the upper end, the elasticity of the material will not be damaged by a seam (or a thread). The reinforcement member for the toe part called a tip padding and the reinforcement member for the heel part called a counter (lunette or hot-melt) is preferably attached between the folded material.

STEP 5): To fix a sole 24 to the open edge 32 of the layered instep-covering part 22. In this case also, it is general to fix an insole (not illustrated) to inside of the opening edge 32 of the material 31 and then fix a main sole (not illustrated) and a heel under the outside of these elements (i.e. under a boot).

Figure 5:
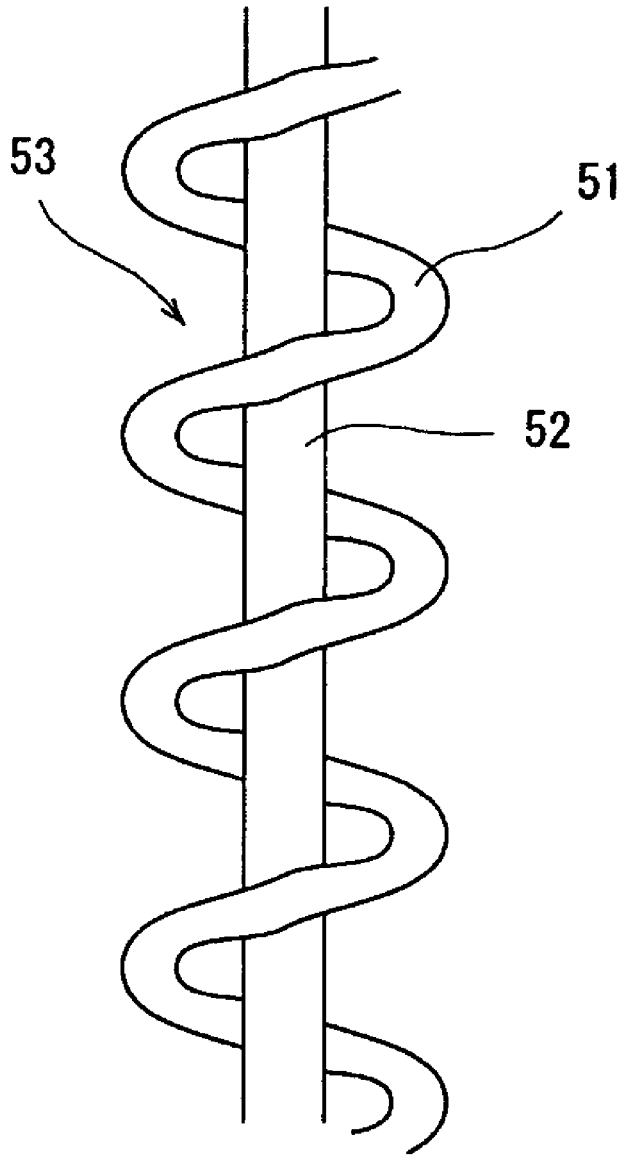
FIG. 5 is a schematic view of the twine 53 which is usable as the multi-function yarn in the boots 1 and 2 of the present invention.
Figure 6:
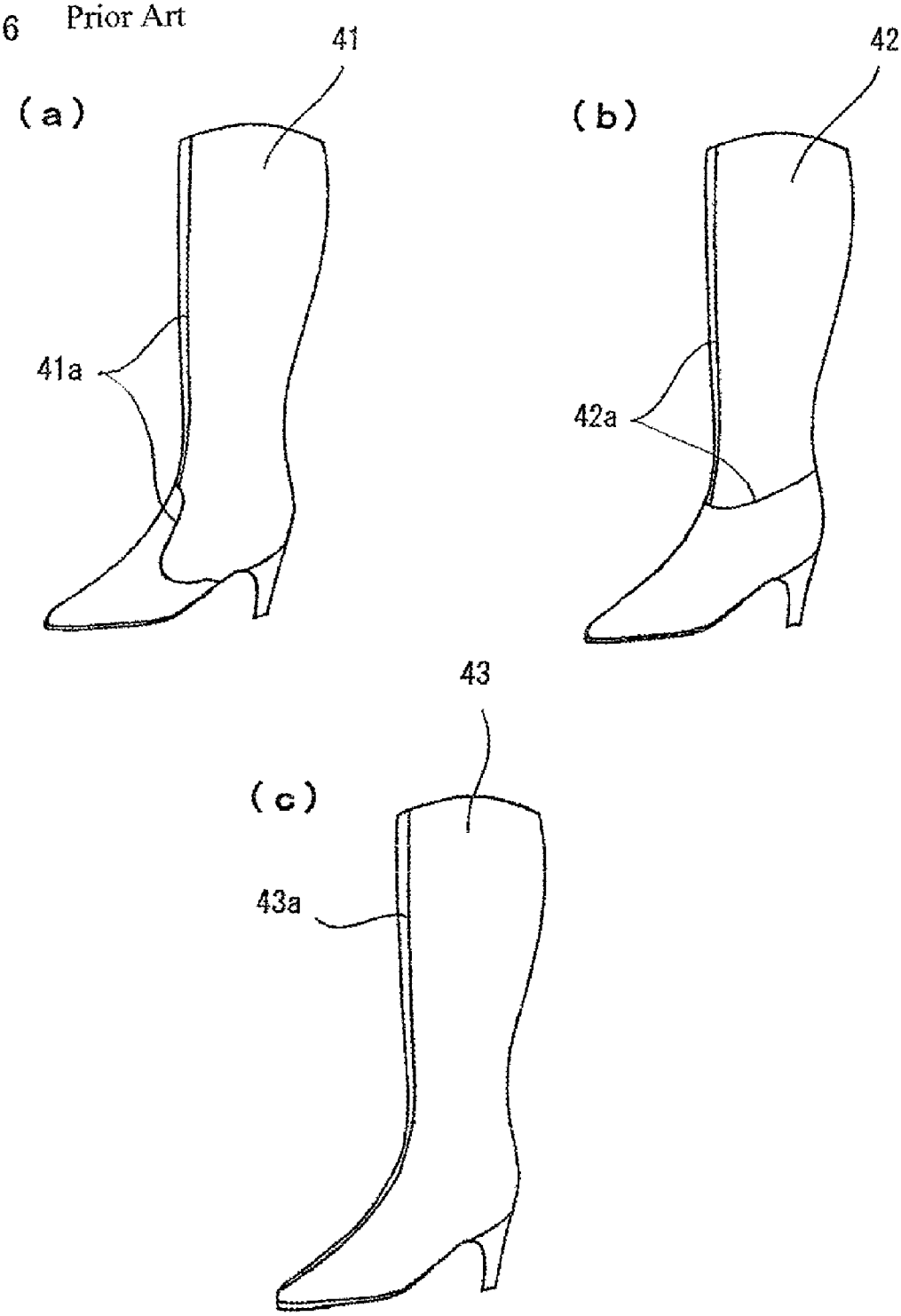
Fig. 6 Prior Art
FIG. 6(*a*)-6(*c*) are perspective views respectively showing the conventional boots 41, 42 and 43.

The boot 1 and 21 can be formed by knitting a yarn which has high elasticity instead of or together with the yarn which has deodorization function, etc. For the multi-function yarn which has high elasticity as well as deodorization function (antibacterial function, or blood circulation promoting function), the twine 53 shown in FIG. 5 can be used for example. The twine 53 is made by spirally twisting a fiber 51 having functions such as deodorization (for example, a rayon fiber into which the minute particles of bincho charcoal is interwoven) around a fiber 52 of high elasticity (for example, an elastic polyester fiber). The twine 53 and the material knitted out of it totally have high elasticity because the fiber 52 is extensible in a wide range based on its original elasticity and the fiber 51, which has poor elasticity though, can follow the change of length as being spirally twisted.

At least the part to fully or partially cover from the calf to the ankle is knitted out of the twine 53. This provides the boot 1 and 21 the deodorizing action (antibacterial action or blood circulation promoting action), makes them nicely fit the leg to show a shapely profile, and further prevents them from slipping down. In the case the twine 53 is used for the boot 21, it is preferable to apply a material knitted out of the twine 53 only to the inner part of the folded cylindrical body. This provides the same effect as wearing a supporter, which is caused by the inner material and makes it possible to pursuit fashion using the outer material. It is a matter of course that the boot can be a long boot to cover over the knee.

Whether the multi-function yarn including the function of high elasticity is used or not, it is preferable to place a flat rubber band (a circular rubber like a belt) near the upper ends 2*a* and 21*a* of the boots 1 and 21 in order to prevent the part of the calf from slipping down. A boot, which has a folded material by folding back a cylindrical body like the boot 21, can hide the flat rubber band in the folded material, therefore being advantageous in the exterior. It is also preferable that, instead of using the flat rubber, only the parts near the upper ends 2*a* and 21*a* are knitted with a stitch pattern generating elasticity (such as a rib stitch) or knitted out of especially high-elastic yarn.

INDUSTRIAL APPLICABILITY

As described above, the boot of the invention has not only the hygienic and health advantages but also the excellent exterior and further is suitable for young ladies and other age groups to wear.

What is claimed is:

1. A boot, comprising: an outer surface entirely made of a material formed into an integrated body continuously knitted out of a yarn, a part at least covering from a toe to an instep of a foot is knitted from a yarn including a fiber into which minute particles, having deodorization function, antibacterial function or blood circulation promoting function, are interwoven;

a cylindrical material provided with an instep-covering part at each end thereof and knitted into a continuous and integrated body is formed by knitting the yarn including the fiber into which said minute particles have been interwoven in the part from a first end to near a half length thereof and formed by knitting another yarn without said minute particles in another half part including a second end, and is folded back in half to form a folded cylindrical body so that the first part knitted out of the yarn including the fiber into which said minute particles have been interwoven is turned inside; and an inextensible piece for fixing a shape of the part covering from the instep to a back of the heel is sewed on inner material of said ends which are overlaid with each other after folding back, wherein the yarn including the fiber into which said minute particles have been interwoven is a twine comprising the fiber into which one or more minute particles selected from among bincho charcoal, a photocatalyst, sulfur, germanium ore, and zirconium ore have been interwoven and other high-elastic fiber; the fiber with the interwoven particles being spirally twisted around the high-elastic fiber so as to follow a change of length.

2. The boot according to claim 1, wherein, in said cylindrical material, only a part which extends to near an upper end after folding back is knitted with a stitch pattern generating elasticity or knitted out of a high-elastic yarn.

3. A boot comprising a part to at least partially cover from a calf to an ankle of a wearer, the part being a knitted part of a multi-function yarn which has high elasticity together with deodorizing function, antibacterial function or blood circulation promoting function, wherein the part knitted out of the multi-function yarn fits a leg while wearing, wherein said multi-function yarn is a twine comprising a fiber into which the minute particles with deodorizing function, antibacterial function or blood circulation promoting function have been interwoven and a further high-elastic fiber, the fiber with interwoven particles being spirally twisted around the high-elastic fiber so as to follow a change of length.

4. The boot according to claim 3, having an entire outer surface made of a material formed into an integrated body by continuously knitting a yarn.

5. The boot according to claim 4, wherein:

the boot is formed to cover the leg and foot with a single material; and further comprising an inextensible piece that fixes the shape of a part covering from an instep to a back of a heel and is covered with and stuck to said material, and said material, only at the back of the heel, has a seam created by sewing with the inextensible piece.

6. The boot according to claim 4, further comprising a cylindrical material with an instep-covering part at each end thereof and knitted into a continuous and integrated body is formed by knitting said multi-function yarn in the part from a first end to near a half length thereof and formed by knitting another yarn except said multi-function yarn in another half part including a second end, and is folded back in half to form a folded cylindrical body so that the first part knitted out of said multi-function yarn is turned inside; and an inextensible piece for fixing a shape of the part covering from the instep to a back of the heel is sewed on inner material of said ends which are overlaid with each other after folding back.

7. The boot according to claim 5, wherein, in said material formed by continuously knitting the yarn, only a part which extends to near an upper end after folding back is knitted with a stitch pattern generating higher elasticity than other parts or knitted out of a more elastic yarn than other parts.

8. The boot according to claim 6, wherein, in said material formed by continuously knitting the yarn, only a part which extends to near an upper end after folding back is knitted with a stitch pattern generating higher elasticity than other parts or knitted out of a more elastic yarn than other parts.

* * * * *